United States Patent [19]

Pierce et al.

[11] 4,254,610

[45] Mar. 10, 1981

[54] STRAND SPLICING APPARATUS

[75] Inventors: Richard H. Pierce, Columbus; Arnold J. Eisenberg, Granville, both of Ohio

[73] Assignee: Owens-Corning Fiberglas Corporation, Toledo, Ohio

[21] Appl. No.: 962,276

[22] Filed: Nov. 20, 1978

Related U.S. Application Data

[62] Division of Ser. No. 864,069, Dec. 23, 1977, Pat. No. 4,143,506.

[51] Int. Cl.[3] ..... B65H 69/06; D02J 1/08

[52] U.S. Cl. ..... 57/22; 28/272; 57/350

[58] Field of Search ..... 57/22, 23, 350, 202; 28/271-273; 242/36, 42

[56] References Cited

U.S. PATENT DOCUMENTS

| | | | |
|---|---|---|---|
| 2,648,890 | 8/1953 | McDonald | 57/22 |
| 3,296,679 | 1/1967 | Jobson | 28/272 |
| 3,345,809 | 10/1967 | Gemeinhardt et al. | 57/22 |
| 3,380,135 | 4/1968 | Wood et al. | 57/22 X |
| 3,388,442 | 6/1968 | Shumaker | 28/272 |
| 3,572,025 | 3/1971 | Irwin | 57/22 |
| 4,002,012 | 1/1977 | Norris et al. | 57/22 |
| 4,010,908 | 3/1977 | Patterson | 242/36 |

FOREIGN PATENT DOCUMENTS

| | | | |
|---|---|---|---|
| 956992 | 4/1964 | United Kingdom | 57/22 |

*Primary Examiner*—John Petrakes

*Attorney, Agent, or Firm*—Ronald C. Hudgens; Philip R. Cloutier; Greg Dziegielewski

[57] ABSTRACT

Method and apparatus for introducing a first strand into a continuously moving second strand are provided by positioning the first strand in spaced relation along the length of the continuously advancing second strand, and laterally moving the first strand to engage the continuously moving second strand such that the first strand is continuously advanced with the second strand.

5 Claims, 6 Drawing Figures

STRAND SPLICING APPARATUS

This is a division of application Ser. No. 864,069 filed Dec. 23, 1977 now U.S. Pat. No. 4,143,506.

BACKGROUND OF THE INVENTION

Textile operations often require simultaneous handling of many continuous linear elements, such as yarns or strands to produce a product such as in roving and beaming. Often, the quality of the product depends upon the ability of the system to keep a positive end count of the strands being processed.

Systems have been developed to sense the advancement of each individual strand in roving processes. However, it has generally been the practice to design and operate the system such that when one strand stops or runs out the total roving system will shut down. The operator then determines which strand feeding position is impaired and then manually repairs the strand break or reinsert a new strand into the roving system. Obviously, this is a very slow and inefficient system.

U.S. Pat. No. 4,010,908, issued Mar. 8, 1977 discloses a photoelectric system for sensing the advancement of the individual strands from its associated supply package.

The specifications for different products can differ, but there has been an increased requirement for accuracy in maintaining a predetermined number of minimum number of rovings or strands in the composite product. Thus, the means for maintaining a positive end count of the number of strands or rovings being combined has been improved to meet the more stringent requirements along with providing a more efficient and reliable system.

SUMMARY OF THE INVENTION

According to this invention, there are provided method and apparatus for inserting a first strand into a continuously advancing second strand by positioning the first strand substantially parallel to but laterally spaced from the continuously moving second strand, and laterally moving the first strand to engage the continuously advancing second strand such that the first strand advances with the continuously advancing second strand.

Accordingly, it is a general object of the present invention to provide a system capable of inserting an auxiliary strand into the system in the absence of stopping the other strand or strands.

The foregoing, as well as other objects of the present invention, will become apparent to those skilled in the art from the following detailed description.

DESCRIPTION OF THE PREFERRED EMBODIMENTS

Figure 1:
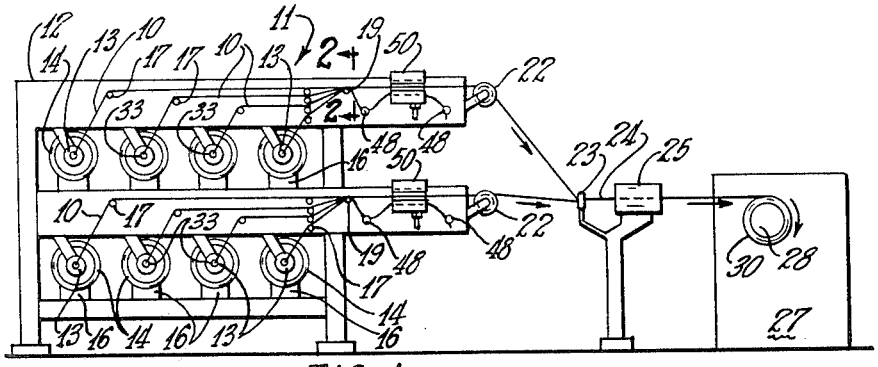
FIG. 1 is an elevational view of a roving process including the strand insertion system.

As shown in FIG. 1 a plurality of strands 10 is being continuously advanced to form a roving 24. Each strand 10 is a bundle of continuous filaments of any suitable material such as glass.

In operation, each strand 10 is advanced from a forming or supply package 14 resting in cradle 16 secured to frame 12 of creel 11. It is well known in the art to position a conical strand control guide 13 at the interior of each package 14 to control the strand as it is being withdrawn from the interior of its associated package. Also located at the forming package 14 is stranded detector 33, which can be attached to the strand control guide 13, and which is adapted to sense the movement or advancement of the strand 10 passing therethrough. The function of the strand detector 33 will be explained later in more detail.

As the strand 10 leaves the zone of the package 14, the strand is positioned by at least one guide pin 17 depending upon the position of the particular package in creel 11. Guide pins 17 are attached to frame 12 and are positioned to keep the individual strands 10 spaced from each other until the strands are gathered together at a preselected zone or zones.

Figure 2:
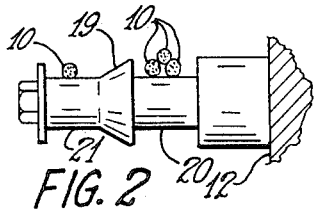
FIG. 2 is an enlarged view of one of the channeled strand guides taken along view 2—2.

As can be seen from FIG. 1, the strands 10 advancing from the first level or group of packages 14 are maintained in a completely separated state until the advancing strands engage channeled strand guide or member 19 and are gathered together as shown in FIGS. 1 and 2.

Generally, during operation, at least one of these strands 10, otherwise known as an auxiliary strand, is maintained in a static state to be automatically inserted into the bundle of advancing strands when one of the advancing strands breaks or runs out.

The strand inserter 50 is oriented in cooperation with the channeled strand guide 19, spring loaded strand holders 48, and guide pulley 22 is position the advancing strands 10 in a first section or zone of cylindrical chamber of passageway 54, and to position at least one auxiliary strand 10, which is stationary, in a second section or zone of the cylindrical passage 54 of strand inserter 50 until the strand inserter is activated to laterally move the auxiliary strand into engagement with the advancing strands such that the auxiliary strand intertwines and/or wraps around the advancing strands such that the auxiliary strand is subsequently continuously advanced with the other continuously advancing strands, the auxiliary strand being laterally moved at a zone downstream of initial gathering of the advancing strands.

As shown in FIG. 1, a two-tiered creel 12 employs a dual system to produce a pair of continuously advancing subrovings or groups of strands which are combined or gathered into a unitary, continuously, advancing roving at guide eye 23.

The roving can be tensioned by a strand tensioner 25, as is well known in the art, as the roving 24 is continuously collected as a wound package 30 upon collet 28 of winder 27.

An advantage of this system is that any one of the packages 14 and associated strands 10 can be utilized as the auxiliary strand.

When one of the packages 14 runs out or breaks, the auxiliary strand is automatically inserted into the remaining advancing strands to maintain a predetermined end count in the roving. Thereafter, the operator supplies another package 14 to the now empty or defective position and rethreads the strand 10 over the appropriate guide pins 17 and channeled strand guide 19 and through strand inserter 50 and the approximate pair of strand holders 48 to "stage" the auxiliary strand.

Figure 3:
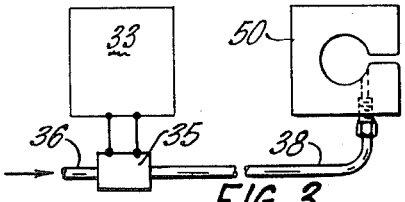
FIG. 3 is a schematic representation of the electromechanical system for automatically inserting an auxiliary strand into a continuously advancing roving.
Figure 5:
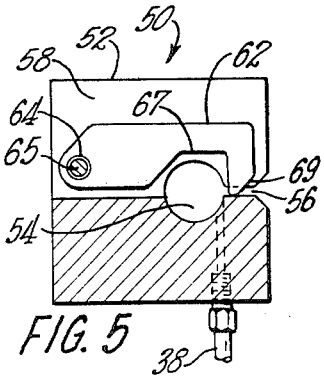
FIG. 5 is a cross-sectional view of the strand inserter shown in FIG. 4 taken along view 5—5.

As depicted in FIG. 3, a suitable strand-out detector 33 for sensing the advancement or movement, as is well known in the art, is electrically interconnected with solenoid operated valve 35 via leads $L_1$ and $L_2$ which is suitably connected with the source of pressurized fluid (not shown), such as air via supply tube 36. In response to the absence of strand movement, valve 35 is activated to supply a pulse of pressurized air to strand inserter 50 via piping 38.

The strand inserter 50 is comprised of body 52 having a preferably cylindrical passageway or chamber 54 extending from one end to the other of body 52. First slot or strand insertion slot 56 of body 52 is in communication between passageway 54 and the exterior of body 52. Slot 56 extends the full length of passageway 54 and thus the entire length of body 52.

Second slot or latch slot 58 communicates with passageway 54 and first slot 56 and is substantially transverse to passageway 54 and strand insertion slot 56.

Latch slot 58 is adapted to accommodate movable arm or member 62 having bore 64 which rotatably engages pin 65 which is rigidly fastened to body 52. Arm 62 as a relieved or recessed section 67 adapted to allow the strands 10 advancing through cylindrical passageway 54 to pass therethrough without contacting arm 62. Furthermore, arm 62 has a chamfered section 69 which is adapted to rest against body 52 at one side of the strand insertion slot 56. That is, the latch is comprised of a movable member 62 spaced from passageway 54, the member 62 being pivotably mounted at one point of member 62 on body 52. Further, the member 62 has an end opposite said pivotably mounted end retractably positioned in first or insertion slot 56.

During "staging" of the auxiliary strand, the operator grasps the auxiliary strand in each hand and slides a section of the strand through strand insertion slot 56 radially toward passageway 54. The force of the strand against the chamfered section 69 rotates arm 62 upwardly allowing the auxiliary strand to be positioned in passageway 54. Once the strand passes the chamfered section 69 of arm 62 the chamfered section returns to its rest position due to the force of gravity acting upon arm 62. That is, arm 62 is adapted to permit the positioning of the auxiliary strand in passageway 54 by forcing the strand against the chamfered section 69 and yet retain the strands within body 52 during activation of the stand inserter.

Fluid inlet or port 60 is in communication with the cylindrical passageway 54 and the exterior of body 52. The portion of fluid inlet 60 at passageway 54 is substantially tangent to passageway 54 to provide a circumferentially swirling stream of fluid, such as air, to interengage the static auxiliary strand with the advancing strand or strands passing therethrough such that the auxiliary strand is advanced therewith. It is preferred, that the fluid inlet passageway 60 be located along the region of communication between strand insertion slot 56 and passageway 54 to allow the auxiliary strand to be readily positioned in passageway 54 at the point of communication of passageway 54 with fluid inlet 60 for ease in "staging" the auxiliary strand.

Figure 6:
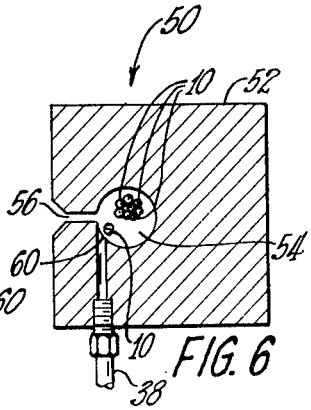
FIG. 6 is a cross-sectional view of the strand inserter shown in FIG. 4 taken along view 6—6.

As shown in FIG. 6, the advancing strands 10 are positioned in the upper right hand quadrant or zone of passageway 54 and the auxiliary strand is positioned in the lower left hand quadrant or zone of passageway 54 to prevent the auxiliary strand from being unintentionally advanced with the moving strands.

Figure 4:
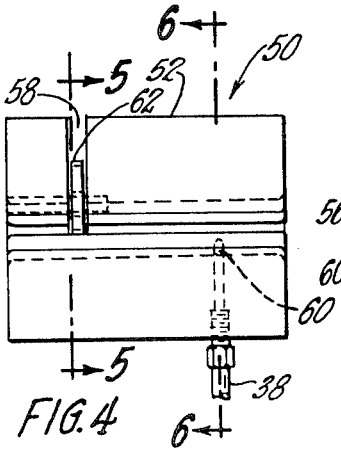
FIG. 4 is a side elevational view of the fluidic strand inserter according to the principles of this invention, the strands advancing from left to right through the inserter.

As can be seen in FIG. 4, the fluid inlet 60 is spaced from latch slot 58 and movable arm 62. If arm 62 were in line with fluid inlet 60 there would be be a tendency for the jet of fluid issuing from inlet 60 to force arm 62 upwardly and thus permitting one of the strands to escape strand inserter 50.

Fluid inlet or port 60 is adapted to receive piping 38 to direct a pulsed stream or jet of fluid into passageway 54 when solenoid valve 35 is activated via strand detector 33.

In operation, the continuously advancing strands and the auxiliary strand are juxoposed lengthwise to each other along the axis of chamber 54. When the solenoid valve 35 is energized, a jet of fluid issues from fluid inlet 60 for a sufficient time to laterally move or swirl the auxiliary strand around the continously advancing strand. In some instances, the auxiliary strand, as well as some of the advancing strands, can be filamentized somewhat by the jet of fluid such that the individual filaments of the auxiliary strand are interengaged in and among the filaments of the advancing strand, or strands, such that the auxiliary strand is advanced with the previously continuously advancing strands.

As shown in FIG. 2, the continuously advancing strands are positioned in the main groove 20 of channeled strand guide 19. Channeled strand guide 19 is fastened to frame 12 along with strand inserter 50, and is positioned such that the advancing strand or strands are located in a first zone of chamber 54 as shown in FIG. 6. Furthermore, guide 19 is adapted to position the auxiliary strand in cooperation with spring clips 48 at a point spaced from the advancing strands to prevent unwanted engagement with the advancing strands. It is prefered that the guide pins 17 and channeled strand guides 19 be made of Alsimag, and it is to be understood that channeled strand guides 19 can be employed in place of guide pins 17 to provide lateral control over the advancing strand.

Channled strand guide or member 19 is adapted to position the auxiliary strand with respect to the advancing strands such that when the strand inserter 50 is energized, the swirling motion induced in the auxiliary strand is transmitted along the length of the auxiliary strand such that the auxiliary strand is automatically moved from the "staged" position or region 21 into the main groove 20.

"V" grooved pulley 22 is axially aligned with the passageway 54 of strand inserter 50 in cooperation with the main groove 20 of strand guide 19 to position the advancing strands in said first zone substantially parallel to the axis of passageway 54.

Spring clips 48, one being located at the inlet of passageway 54 and the other being located at the exit of passageway of 54, are fastened to frame 12 and positioned such that the auxiliary strand will be located in a second zone spaced from the first zone containing the continuously advancing strands.

Spring loaded strand holders or clips 48 can be of the type wherein a conventional helical spring presses a movable plate against a rigidly positioned plate. The auxiliary strand is placed between such plates and the force exerted by the spring holds the auxiliary strand in place until the strand inserter 50 is energized. Only a very light pressure is needed since the spring clips 48 must release the auxiliary strand when the jet of fluid urges the auxiliary strand into lateral engagement with the continuously advancing strand or strands.

It will be appreciated that variations and constructional features, as well as substitution of equivalent components and methods, can be undertaken without departing from the spirit and scope of the present invention.

I claim:

1. In apparatus for splicing a plurality of strands comprising a body having a passageway extending from one end of the body to the other, a first slot communicating with the exterior of the body and with the passageway throughout the length of the passageway, and a fluid inlet communicating with the first passageway and the exterior of the body wherein the improvement comprises:

a movable member spaced from the passageway having a first end pivotally mounted on said body and having a second end opposite said first end retractably positionable in said first slot to retain the strands in said body when a fluid is supplied through said inlet to splice said strands in said passageway.

2. The apparatus of claim 1 wherein the improvement further comprises a second slot in said body substantially transverse to the first passageway and in communication therewith, said member being accommodated by the second slot.

3. The apparatus of claim 2 wherein said movable member has a chamfered section at said second end adapted to allow a strand to pass through the first slot into said passageway as a strand is pressed against said chamfered section toward said passageway.

4. The apparatus of claim 3 wherein the fluid inlet is laterally spaced from the movable member.

5. The apparatus of claim 1 wherein the axis of rotation of the movable member is spaced from the center line of the first passageway.

* * * * *

UNITED STATES PATENT AND TRADEMARK OFFICE

CERTIFICATE OF CORRECTION

PATENT NO. : 4,254,610

DATED : March 10, 1981

INVENTOR(S) : Richard H. Pierce and Arnold J. Eisenberg

It is certified that error appears in the above—identified patent and that said Letters Patent is hereby corrected as shown below:

Line 29, Column 1: The word "of" should be changed to "or".

Line 43, Column 2: The word "is" should be changed to "to".

Line 24, Column 4: The word "continously" should be changed to "continuously".

Signed and Sealed this

*Ninth* Day of *June 1981*

[SEAL]

*Attest:*

RENE D. TEGTMEYER

*Attesting Officer* *Acting Commissioner of Patents and Trademarks*